US008766523B2

(12) United States Patent
Walther et al.

(10) Patent No.: US 8,766,523 B2
(45) **Date of Patent: *Jul. 1, 2014**

(54) ELECTRON BEAM EXIT WINDOW IN ELECTRON BEAM EMITTER AND METHOD FOR FORMING THE SAME

(75) Inventors: Steven R. Walther, Andover, MA (US); Gerald M. Friedman, New Ipswich, NH (US); Michael L. Bufano, Belmont, MA (US)

(73) Assignee: Hitachi Zosen Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/618,682

(22) Filed: Sep. 14, 2012

(65) Prior Publication Data

US 2013/0009077 A1 Jan. 10, 2013

Related U.S. Application Data

(63) Continuation of application No. 12/837,914, filed on Jul. 16, 2010, now Pat. No. 8,339,024.

(60) Provisional application No. 61/226,925, filed on Jul. 20, 2009.

(51) Int. Cl.
*H01J 33/04* (2006.01)

(52) U.S. Cl.
USPC ..... 313/420; 313/46; 313/361.1; 250/492.3

(58) Field of Classification Search
None
See application file for complete search history.

(56) References Cited

U.S. PATENT DOCUMENTS

| | | | | |
|---|---|---|---|---|
| 5,621,270 | A * | 4/1997 | Allen | 313/420 |
| 6,240,640 | B1 * | 6/2001 | Matsuoka et al. | 29/897.32 |
| 6,545,398 | B1 * | 4/2003 | Avnery | 313/361.1 |
| 6,674,229 | B2 * | 1/2004 | Avnery et al. | 313/420 |
| 2004/0207071 | A1 * | 10/2004 | Shiomi et al. | 257/704 |
| 2006/0268074 | A1 * | 11/2006 | Hori | 347/68 |
| 2008/0180469 | A1 * | 7/2008 | Katayama | 347/1 |

* cited by examiner

*Primary Examiner* — Sikha Roy
(74) *Attorney, Agent, or Firm* — Fildes & Outland, P.C.

(57) ABSTRACT

An exit window can include an exit window foil, and a support grid contacting and supporting the exit window foil. The support grid can have first and second grids, each having respective first and second grid portions that are positioned in an alignment and thermally isolated from each other. The first and second grid portions can each have a series of apertures that are aligned for allowing the passage of a beam therethrough to reach and pass through the exit window foil. The second grid portion can contact the exit window foil. The first grid portion can mask the second grid portion and the exit window foil from heat caused by the beam striking the first grid portion.

18 Claims, 7 Drawing Sheets

ELECTRON BEAM EXIT WINDOW IN ELECTRON BEAM EMITTER AND METHOD FOR FORMING THE SAME

RELATED APPLICATION

This application is a continuation of U.S. patent application Ser. No. 12/837,814, filed on Jul. 16, 2010, which claims the benefit of U.S. Provisional Application No. 61/226,925, filed on Jul. 20, 2009. The entire teachings of the above application are incorporated herein by reference.

BACKGROUND

An electron beam emitter typically includes an electron gun or generator, positioned within a vacuum chamber for generating electrons. The generated electrons can exit the vacuum chamber in an electron beam through an electron beam transmission or exit window that is mounted to the vacuum chamber. The exit window commonly has a thin metallic exit window foil, which is supported by a metallic support plate or grid. The support plate has a series of holes which allow electrons to reach and pass through the exit window foil. The support plate dissipates heat from the exit window foil caused by electrons passing through the exit window foil. However, electrons that are instead intercepted by the support plate areas between the holes cause heating of the support plate, which can reduce the ability of the support plate to dissipate heat from the exit window foil.

SUMMARY

The present invention can provide an exit window including an exit window foil, and a support grid contacting and supporting the exit window foil, in which the exit window foil can operate at lower temperatures than in the prior art. The support grid can have first and second grids, each having respective first and second grid portions that are positioned in alignment and thermally isolated from each other. The first and second grid portions can each have a series of apertures that are aligned for allowing the passage of a beam therethrough to reach and pass through the exit window foil. The second grid portion can contact the exit window foil. The first grid portion can mask the second grid portion and the exit window foil from heat caused by the beam striking the first grid portion.

In particular embodiments, the exit window can be in an electron beam emitter and the beam can be an electron beam. The thermal isolation of the first and second grid portions can provide the second grid portion with a lower temperature than the first grid portion during operation, and allow heat to be more readily conducted from the exit window foil. The first and second grid portions can be spaced apart from each other by a gap. In some embodiments, the first and second grid portions can be spaced apart by thermal insulating material. The first grid portion can provide thermal masking for the second grid portion by direct beam interception. An electrical source can be connected to at least one of the first and second grid portions for causing the deflection of the beam to reduce beam interception by the support grid. The second grid portion and the exit window foil can be formed of materials having substantially similar coefficients of thermal expansion. The second grid portion can have a grid surface on which the exit window foil is bonded continuously. The second grid portion can be contoured to provide additional surface area to mitigate affects of thermal expansion stretching or gathering of the exit window foil.

The present invention can also provide an electron beam emitter which can include a vacuum chamber, an electron generator positioned within the vacuum chamber for generating electrons, and an exit window mounted to the vacuum chamber for allowing passage of electrons out the vacuum chamber through the exit window in an electron beam. The exit window can have an exit window foil and a support grid contacting and supporting the exit window foil. The support grid can have first and second grids, each having respective first and second grid portions that are positioned in alignment and thermally isolated from each other. The first and second grid portions can each have a series of apertures that are aligned for allowing the passage of the electron beam therethrough to reach and pass through the exit window foil. The second grid portion can contact the exit window foil. The first grid portion can mask the second grid portion and the exit window foil from heat caused by the electron beam striking the first grid portion.

In particular embodiments, the thermal isolation of the first and second grid portions can provide the second grid portion with a lower temperature than the first grid portion during operation, and allow heat to be more readily conducted from the exit window foil. The first and second grid portions can be spaced apart from each other by a gap. In some embodiments, the first and second grid portions can be spaced apart by thermal insulating material. The first grid portion can provide thermal masking for the second grid portion by direct beam interception. An electrical source can be connected to at least one of the first and second grid portions for causing the deflection of the beam to reduce beam interception by the support grid. The second grid portion and the exit window foil can be formed of materials having substantially similar coefficients of thermal expansion. The second grid portion can have a grid surface on which the exit window foil can be bonded continuously. The second grid portion can be contoured to provide additional surface area to mitigate effects of the thermal expansion stretching or gathering of the exit window foil.

The present invention can also provide a method of reducing heat on an exit window foil of an exit window. The exit window foil can be contacted and supported with a support grid. The support grid can have first and second grids, each having respective first and second grid portions that are positioned in alignment and thermally isolated from each other. The first and second grid portions can each have a series of apertures that are aligned for allowing the passage of a beam therethrough to reach and pass through the exit window foil. The second grid portion can contact the first exit window foil. The first grid portion can mask the second grid portion and the exit window foil from heat caused by the beam striking the first grid portion.

In particular embodiments, the exit window can be in an electron beam emitter and can allow passage of an electron beam. Heat can be allowed to be more readily conducted from the exit window foil by providing the second grid portion with a lower temperature than the first grid portion during operation by the thermal isolation of the first and second grid portions. The first and second grid portions can be spaced apart from each other by a gap. In some embodiments, the first and second grid portions can be spaced apart from each other by thermal insulating material. The first grid portion can provide thermal masking for the second grid portion by direct beam interception. An electrical source can be connected to at least one of the first and second grid portions for causing deflection of the beam to reduce beam interception by the support grid. The second grid portion and exit window foil can be formed from the materials having substantially similar coefficients of thermal expansion. The exit window foil can be bonded continuously on a grid surface of the second grid portion. The second grid portion can be contoured to provide additional surface area to mitigate effects of thermal expansion stretching or gathering of the exit window foil.

The present invention can also provide a method of reducing heat in an exit window foil of an exit window on an electron beam emitter. The electron beam emitter can have a vacuum chamber, and an electron generator positioned within the vacuum chamber for generating electrons. The exit window can be mounted to the vacuum chamber for allowing passage of electrons out the vacuum chamber through the exit window in an electron beam. The exit window foil can be contacted and supported with a support grid. The support grid can have first and second grids, each having respective first and second grid portions that are positioned in alignment and thermally isolated from each other. The first and second grid portions can each have a series of apertures that are aligned for allowing the passage of the electron beam therethrough to reach and pass through the exit window foil. The second grid portion can contact the exit window foil. The first grid portion can mask the second grid portion and the exit window foil from heat caused by the electron beam striking the first grid portion.

In particular embodiments, heat can be allowed to be more readily conducted from the exit window foil by providing the second grid portion with a lower temperature than the first grid portion during operation by the thermal isolation of the first and second grid portions. The first and second grid portions can be spaced apart from each other by a gap. In some embodiments, the first and second grid portions can be spaced apart from each other by thermal insulating material. The first grid portion can provide thermal masking for the second grid portion by direct beam interception. An electrical source can be connected to at least one of the first and second grid portions for causing deflection of the beam to reduce beam interception by the support grid. The second grid portion and the exit window foil can be formed from materials having substantially similar coefficients of thermal expansion. The exit window foil can be continuously bonded on a grid surface of the second grid portion. The second grid portion can be contoured to provide additional surface area to mitigate effects of thermal expansion stretching or gathering of the exit window foil.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

Figure 1:
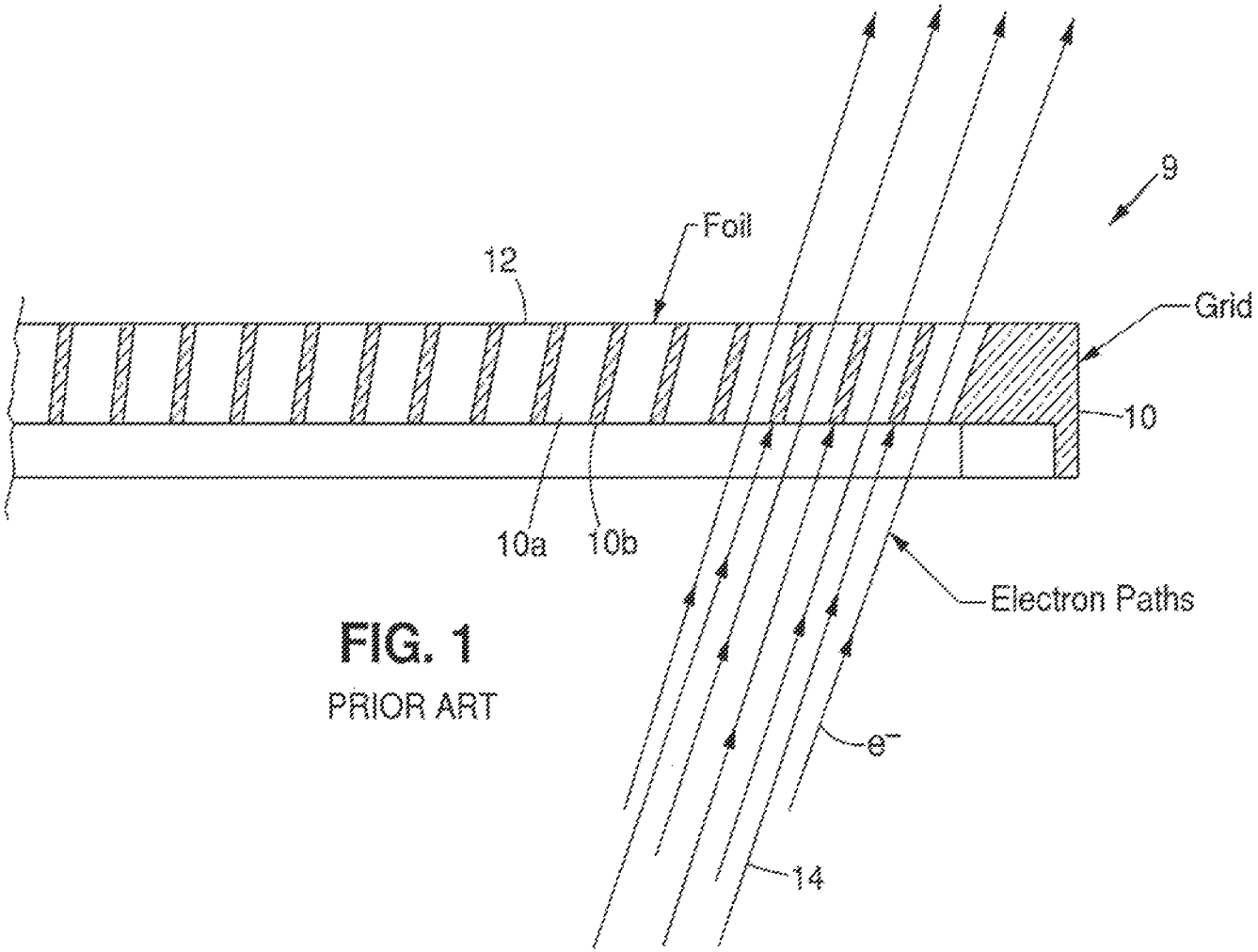
FIG. 1 PRIOR ART
FIG. 1 is a sectional drawing of a common prior art exit window.

FIG. 1 depicts a common prior art exit window 9 having a thermally conductive support plate or grid 10 for supporting an exit window foil 12 on an electron beam emitter. The support grid 10 is often copper and the exit window foil is often titanium. The support grid 10 has a series of apertures, holes or openings 10*a* for allowing passage of electrons $e^-$ of an internal electron beam 14 therethrough in order to reach and pass through the exit window foil 12 for emission from the electron beam emitter. Support plate or grid areas 10*b* between the holes 10*a* intercept or block a fraction or portion of the electrons $e^-$ of the electron beam 14. The amount of the electron beam 14 that is transmitted to or reaches the exit window foil 12 is in proportion to the ratio of the hole area to support plate or grid area normal to electron trajectories. For typical grids, this amount can be in the range of 50% to 80% or more. The portion of the electron beam intercepted by the grid 10 is absorbed by the grid 10 and is dissipated as heat that is typically removed to an external source of cooling. The electrons $e^-$ of the electron beam 14 that pass through the holes 10*a* of the grid 10 and through the exit window foil 12 cause some heating of the exit window foil 12 that is also typically removed through the grid 10 to the external source of cooling. The exit window 9 temperature increases in proportion to the heat dissipated in both the exit window foil 12 and the grid 10.

For example, a 150 keV 10 mA (1500 W) beam that passes through a 70% transparent grid 10 will dissipate 450 W (150 keV*10 mA*30%/100%=450 W) directly on the grid 10. The remaining 1050 W of beam power is incident on the exit window foil 12, which may transmit ~96.4% of the beam energy for a 7 micron thick titanium foil. Thus 1050 W*0.964=1012 W of beam power is transmitted through the exit window foil 12 and about 38 W is dissipated in the exit window foil 12. The grid 10 must remove the total heat load of 488 W, of which the exit window foil 12 heat load in only about 8%. The units used are as follows: keV=kilo electron volts, mA=milliamperes, W=watts, C=degrees celsius and cm=centimeter.

In this example, the full heat load creates an elevated temperature in the grid 10, which must also remove the heat load from the exit window foil 12. For an example grid 10 (copper, 25 cm long by 0.6 cm thick, 70% transparent, a 5 cm path to a water cooled heat sink, and a line heat load of 488 W for simplicity), the peak temperature difference between the center and edge of the grid would be about 140 deg. C. The increased temperature of the foil at the center may lead to mechanical failure, oxidation, and fatigue failure. Thermal loads on the grid 10 and the exit window foil 12 may result in thermal expansion. If the grid 10 and the exit window foil 12 undergo thermal expansion at differing amounts, exit window foil 12 may have compromised mechanical performance and result in loss of vacuum integrity.

Figure 2:
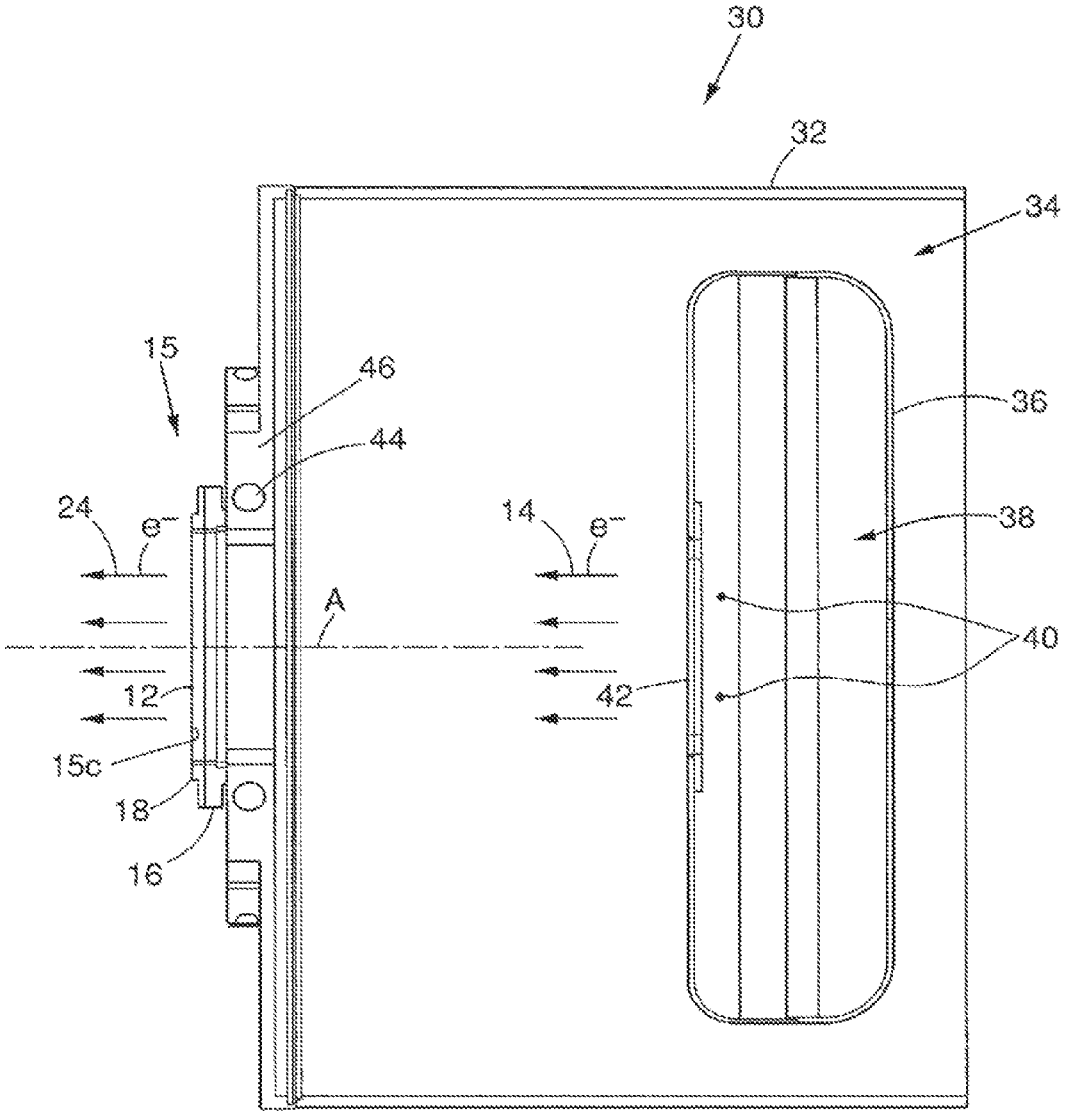
FIG. 2 is a cross sectional drawing of a portion of an embodiment of an electron beam emitter in the present invention.
Figure 3:
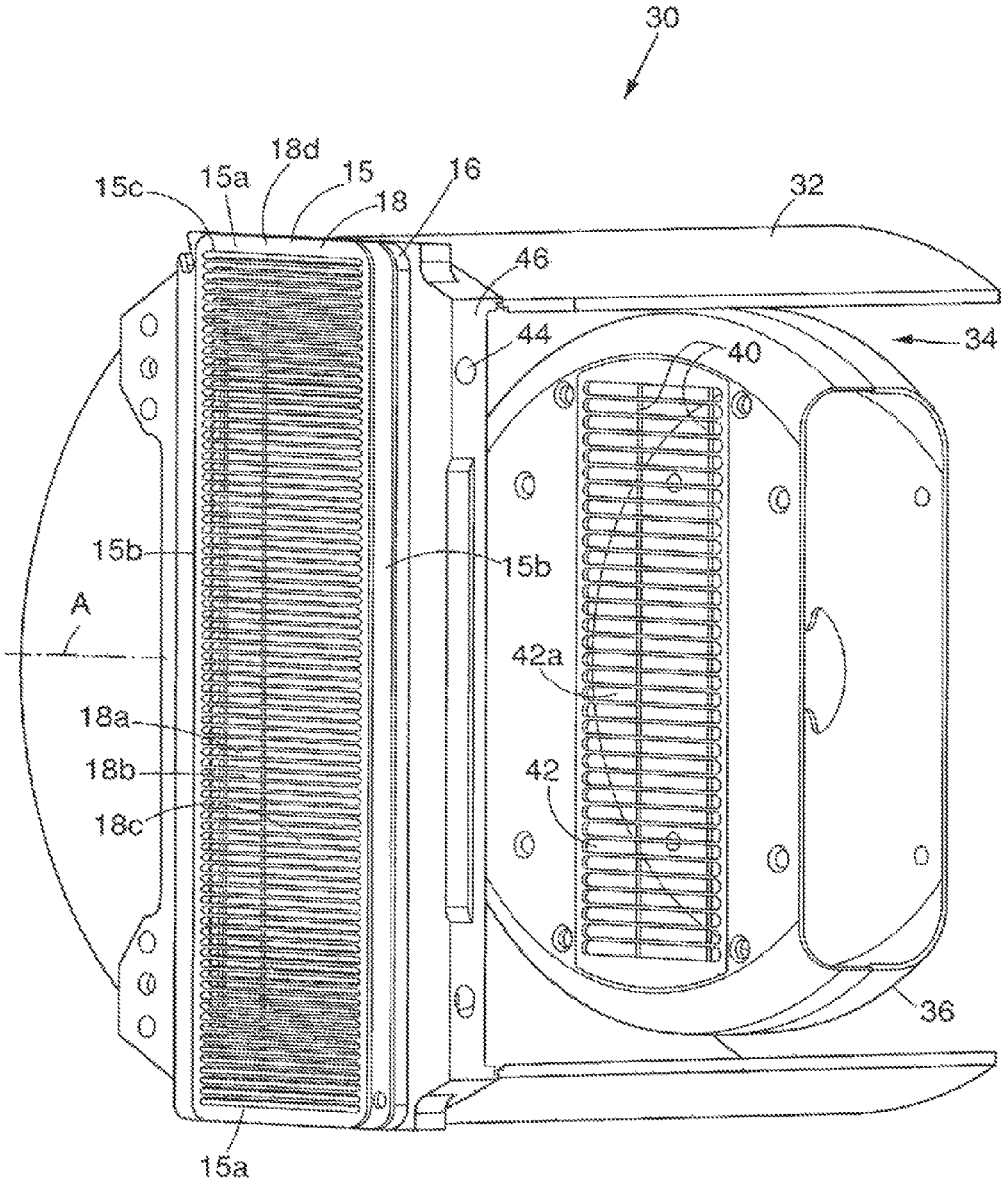
FIG. 3 is a perspective sectional drawing of the electron beam emitter of FIG. 2.

Referring to FIGS. 2 and 3, in one embodiment in the present invention, electron beam emitter or accelerator 30 can have an electron generator or gun 36 positioned within the interior 34 of a vacuum chamber 32 for generating electrons $e^-$ for emission out an electron beam transmission or exit window 15 in an external electron beam 24. The electron generator 36 can include a round disc shaped enclosure surrounding one or more electron generating members or filaments 40, for example two elongate filaments, positioned within the interior 38. In other embodiments, the electron generator 36 and the electron generating members 40 can have other shapes and configurations. Electrons $e^-$ generated by the filaments 40, for example when electrically heated, can exit the electron generator 36 through an electron permeable region 42, which can include apertures, holes or openings 42*a*, such as slots. The electrons $e^-$ exiting the electron generator 36 are directed towards the exit window 15 in an internal electron beam 14, when subjected to a voltage potential between the electron generator 36 and the exit window 15. Electrons $e^-$ passing through the exit window 15 are then transmitted as an external electron beam 24 generally in the direction of axis A. The electron permeable region 42 of the electron generator 36 and the exit window 15 can have an elongate rectangular shape for generating a wide rectangular external electron beam 24. For example, in some embodiments, the exit window 15 can be about 25 cm long by about 7.5 cm wide. The exit window 15 can be mounted to the vacuum chamber 32 spaced apart from and facing the electron permeable region 42 of the electron generator 36, and can be mounted on a cooling system or structure 46. The cooling structure 46 can include cooling passages 44 for circulating cooling fluid, for example water, for cooling the exit window 15. The exit window 15 and the vacuum chamber 32 can be hermetically sealed so that active vacuum pumps are not required to maintain a vacuum within the interior 34. In some embodiments, different vacuum chamber and exit window designs can be used where an active vacuum pump may be desired.

Figure 4:
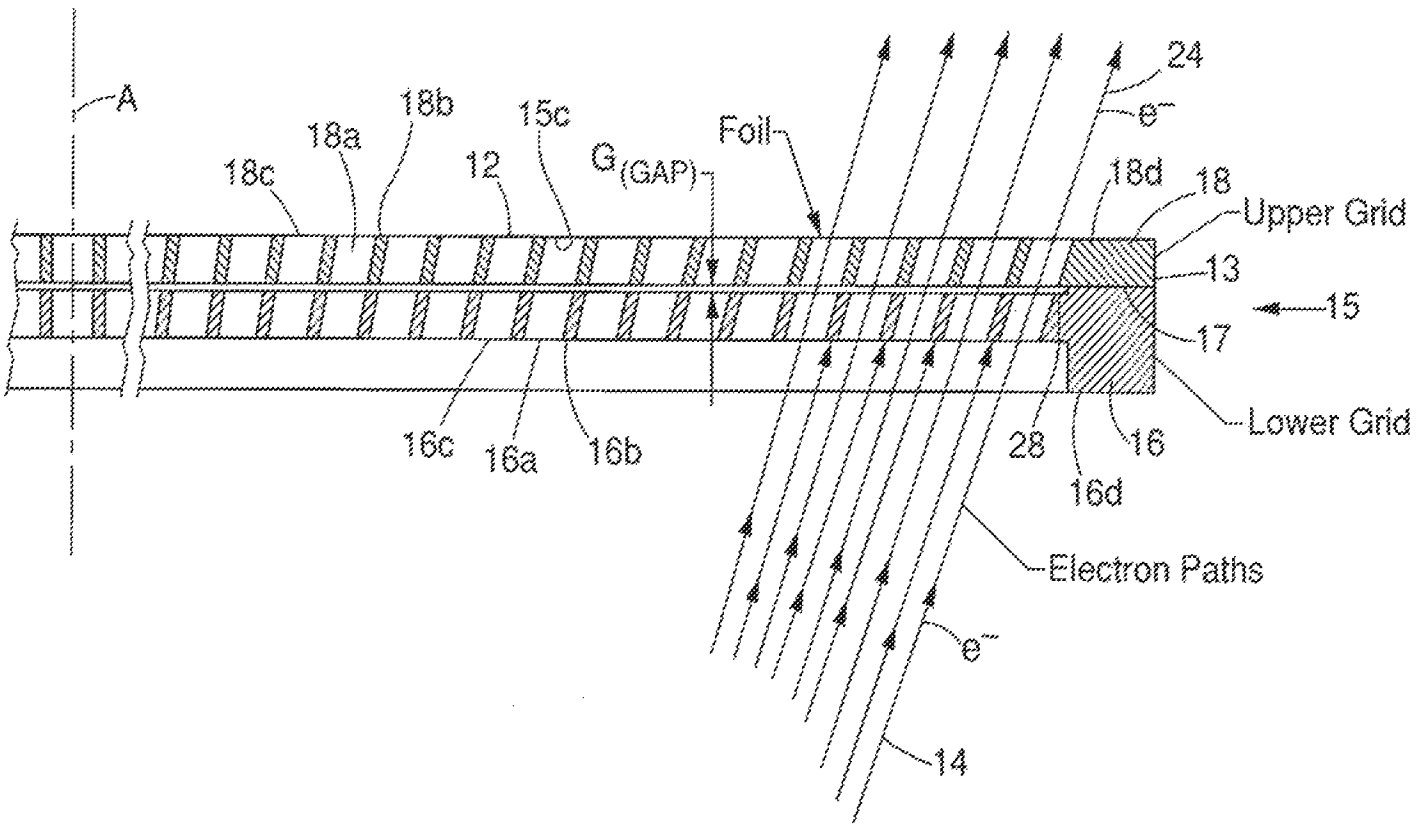
FIG. 4 is a sectional drawing of a portion of an embodiment of an exit window in the present invention.

Referring to FIG. 4, in one embodiment, the exit window 15 can include a support plate or grid 13 having a first, lower, upstream or inner support plate or grid 16, and a second, upper, downstream or outer support plate or grid 18 to which the exit window foil 12 is mounted over an outer or outer facing grid surface 15*c*. Both or one of the first 16 and second 18 grids can be cooled by the cooling structure 46. The first grid 16 can have an outer perimeter 16*d* surrounding an interior first grid portion 16*c*. The first grid portion 16*c* can have a series of apertures, holes or openings 16*a*, which can be for example, elongate slots, and can extend towards the sides 15*b* of the exit window 15 (FIG. 3). The apertures 16*a* can be separated from each other by support plate or grid solid material areas or regions 16*b* that are between the apertures 16*a*, which can be for example, elongate ribs which can extend towards the sides 15*b*, and can be connected to the outer perimeter 16*d*. The second grid 18 can have an outer perimeter 18*d* surrounding an interior second grid portion 18*c*. The second grid portion 18*c* can have a series of apertures, holes or openings 18*a*, which can be for example, elongate slots, which can extend towards the sides 15*b*. The apertures 18*a* can be separated from each other by support plate or grid solid material areas or regions 18*b* that are between the apertures 18*a*, which can be for example, elongate ribs, which can extend towards the sides 15*b*, and can be connected to the outer perimeter 18*d*. The outer perimeters 16*d* and 18*d*, grid portions 16*c* an 18*e*, apertures 16*a* and 18*a*, and the solid material regions 16*b* and 18*b*, can be of other shapes or configurations than shown.

The first 16 and second 18 grids can be mounted or stacked together axially along axis A such that the apertures 16*a* and 18*a*, and solid material regions 16*b* and 18*b*, are aligned with each other generally longitudinally or axially in the direction of axis A, or in the direction or the electron beam 14, while at the same time the first 16*c* and second 18*c* grid portions are thermally isolated from each other. The thermal isolation of the first 16*c* and second 18*c* grid portions can be achieved by spacing the first 16*c* and second 18*c* grid portions apart from each other by a gap G, such as a vacuum gap, within the vacuum chamber 32. Since the first 16*c* and second 18*c* grid portions are separated by a vacuum gap G, very little heat is transmitted across the gap G between the grid portions 16*c* and 18*c*. In the embodiment shown in FIG. 4, the gap G can be formed by recessing the first grid portion 160 within the first grid 16 below a raised shoulder 28 at the outer perimeter 16*d*. As a result, when the outer perimeters 16*d* and 18*d* are mounted or joined together along mounting line or joint 17, the first 16*c* and second 18*c* grid portions can be spaced apart from each other. In some embodiments, the gap G can be about 0.015 inches, which can be large enough to provide thermal isolation while at the same time minimizing size, but can be larger or smaller depending upon the situation at hand. In some embodiments, a spacer can be used instead of making a raised shoulder 28.

The apertures 16*a* and 18*a* can progressively angle outwardly moving towards the outer perimeter 16*d* and 18*d* towards the ends 15*a* of exit window 15. Apertures 16*a* and 18*a* near the central axis A (FIGS. 3 and 4) can be parallel to axis A, while apertures 16*a* and 18*a* moving away from the axis A towards ends 15*a* can begin to angle outwardly. In some embodiments, all the apertures 16*a* and 18*a* can be parallel to axis A.

With the apertures 16*a* and 18*a* of the first 16*c* and second 18*c* grid portions being aligned, the first grid portion 16*c* of the first grid 16 can act as a mask for the second grid portion 18*c* of the second grid 18. Electrons $e^-$ that are not aligned with apertures 16*a* and 18*a* can be blocked or intercepted by the solid material regions 16*b* of the first grid portion 16*c*, while electrons $e^-$ that are aligned with apertures 16*a* and 18*a* can pass through and out the exit window foil 12. Substantially all electrons $e^-$ or energy passing through the apertures 16*a* of the first grid portion 16*c* can pass through the apertures 18*a* of the second grid portion 18*c*. Consequently, the first grid portion 16*c* of the first grid 16 can act as an electron beam and/or a heat mask or shield for the second grid portion 18*c* of the second grid 18 due to the alignment of apertures 16*a* and 18*a*, and the thermal isolation of the first grid portion 16*e* from the second grid portion 18*c*. The first grid portion 16*c* of the first grid 16 is subject to the heat load of direct electron $e^-$ interception, and this heat load is thermally isolated from the second grid portion 18*c* of the second grid 18. Therefore, the second grid portion 18*c* and second grid 18 can act as a heat sink primarily for the heat generated in or dissipated into the exit window foil 12 by electrons $e^-$ passing through the exit window foil 12. Since the majority of the heat or thermal load absorbed by the exit window 15 is absorbed by the first grid portion 16*c* and first grid 16, and is isolated from the second grid portion 18*c*, the exit window foil 12 of exit window 15 can be at lower temperatures at equivalent power levels when electron beam emitter 30 is operated in comparison to the exit window 9 of FIG. 1, which can improve reliability. Alternatively, this also allows the exit window foil 12 of exit window 15 to withstand substantially higher electron beam power levels than the exit window 9 of FIG. 1.

In comparison with the power example previously discussed for exit window 9 of FIG. 1, for an exit window 15 with grid portions 16*e* and 18*e* each having about half the thickness of the one grid 10 and the same transparency (for example, two copper grids 16 and 18, each 25 cm long by 0.3 cm thick and 70% transparent), then the peak temperature difference of the grid 18 contacting the exit window foil 12 can be significantly lower, and can be only about 22 deg. C. (0.3 cm thick grid with 38 W heat load). In this case the first grid 16 would operate at a much higher temperature difference of about 258 deg. C. (0.3 cm thick grid with 450 W heat load). For a 20 deg. C. heat sink, the single grid 10 in the prior art would have the exit window foil 12 dissipate its heat load to a peak grid temperature of 160 deg. C., vs. the masked grid exit window 15 where the exit window foil 12 would dissipate heat to a much lower peak grid temperature of 42 deg. C., thereby allowing heat to be removed from the exit window foil 12 more easily. In some embodiments of rectangular copper grids 16 and 18 that are 0.3 cm thick, grid portions 16*c* and 18*e* can be about 25 cm long and about 7.5 cm wide, apertures 16*a* and 18*a* can be about 7.5 cm long and about 0.25 cm wide, and solid regions 16*b* and 18*b* can be about 7.5 cm long and about 0.05 cm wide. It is understood that these dimensions vary depending upon the application at hand, and the configurations can also differ.

Figure 5:
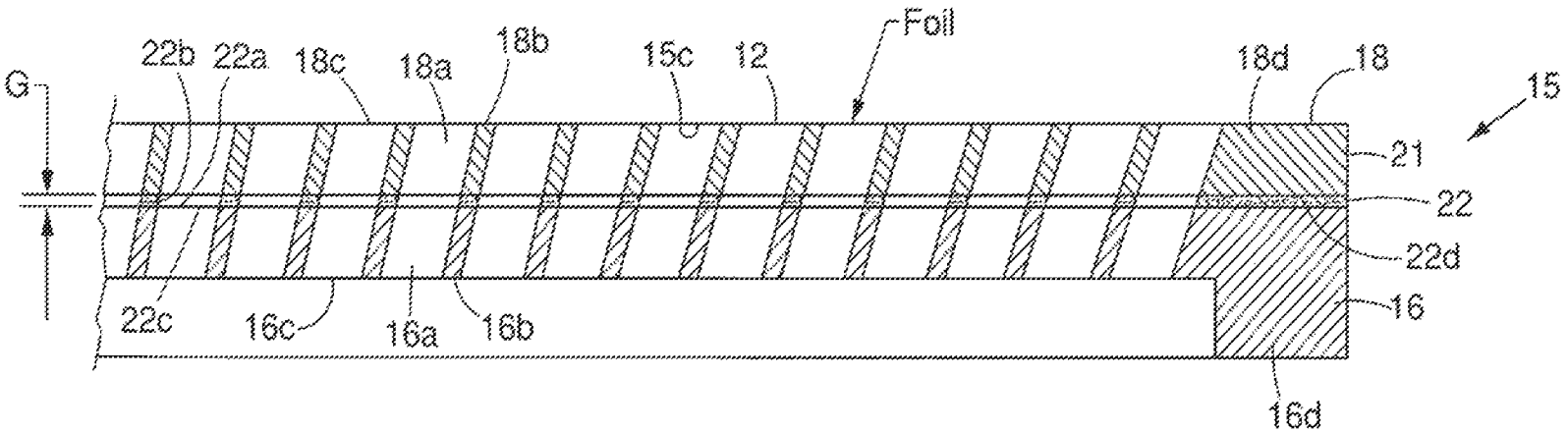
FIG. 5 is a sectional drawing of a portion of another embodiment of an exit window in the present invention.

Referring to FIG. 5, in another embodiment, exit window 15 can have a support plate or grid 21 which differs from support plate or grid 13 in that grid 21 can include a thermally insulating member or layer 22 of thermally insulating material in the gap G, such as alumina (Al2O3) spacing or separating the first 16*c* and second 18*e*, and/or the first 16 and second 18 grids, apart from each other to isolate the thermal loads on the first grid portion 16*c* or first grid 16 from the second grid portion 18*e* or second grid 18. In one embodiment, the insulating member 22 can be positioned between and separate both the outer perimeters 16*d* and 18*d*, of the first 16 and second 18 grids, as well as the first grid portion 16*e* and the second grid portion 18*c*. Consequently, the insulating member 22 can have an outer perimeter portion 22*d* between the outer perimeters 16*d* and 18*d*, and a grid portion 22*c* between the first 16*c* and second 18*c* grid portions. The grid portion 22*c* of the insulating member 22 can have apertures 22*a* and solid insulating material areas or regions 22*b* positioned between the apertures 22*a*. The apertures 22*a* and regions 22*b* can match the respective apertures 16*a* and 18*a*, and respective regions 16*b* and 18*b* of the grids 16 and 18. Consequently, substantially all of the electrons $e^-$ or electron beam energy passing through the apertures 16*a* of the first grid portion 16*e* can also pass through the apertures 22*a* of insulating member 22 and the apertures 18*a* of the second grid portion 18*c*. Although the insulating member 22 is shown in contact with grids 16 and 18, in some embodiments, some or all of insulating member 22 can be spaced from grids 16 and 18. In some embodiments, the insulating member 22 can only include an outer perimeter portion 22*d*, whereby the first 16*c* and second 18*c* grid portions have an empty space or vacuum gap therebetween. In other embodiments, the insulating member 22 can have a grid portion 22*c*, with the outer perimeters 16*d* and 18*d* of the first 16 and second 18 grids being joined together along a mating line 17. In still other embodiments, portions of these embodiments can be used or combined.

Figure 6A:
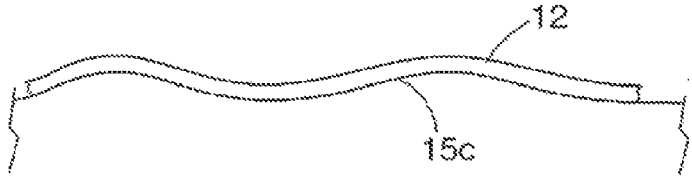
FIG. 6A is a schematic drawing showing an outer grid surface with a non-planar contoured surface.
Figure 6:
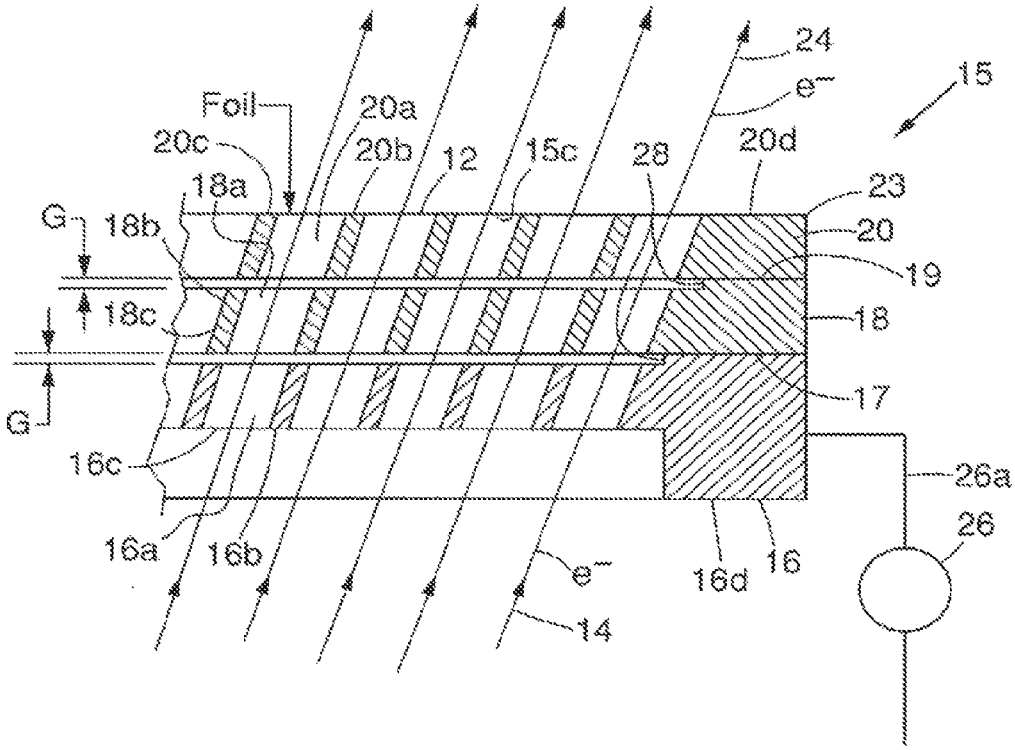
FIG. 6 is a sectional drawing of a portion of yet another embodiment of an exit window in the present invention.

Referring to FIG. 6, in another embodiment, exit window 15 can include a support plate or grid 23 which differs from support plate or grid 13 in that an outer, upper or third grid 20 can be axially mounted to second or intermediate grid 18 along mating line or joint 19 in the down stream direction of the electron beam 14 along axis A. The exit window foil 12 can be mounted over the outer grid surface 15*c* of the third grid 20. The third grid 20 can have an outer perimeter 20*d* surrounding an interior third grid portion 20*c*. The third grid portion 20*c* can have apertures, holes or openings 20*a* and support plate or grid solid material areas or regions 20*b*, which match and are aligned in the direction of the electron beam 14, with the respective or corresponding apertures 16*a* and 18*a* and solid regions 16*b* and 18*b* of the first 16*c* and second 18*e* grid portions. Consequently, substantially all electrons $e^-$ passing through apertures 16*a* and 18*a* can pass through apertures 20*a* for passage through the exit window foil 12. The grid portions 16*c*, 18*c* and 20*c* can be separated from each other by a vacuum gap G, similar to that in FIG. 4. Alternatively, one or more spacers can be used, or one or more thermally insulating members or layers 22, such as those shown and described for FIG. 5. The intermediate grid portion 18*c* can further isolate the heat load on the first grid portion 16*c* from the exit window foil 12. The grids 16, 18 and 20 can be made of the same materials, or can be different materials. In some embodiments, the first grid 16 can dissipate heat radiatively, while the last or third grid 20 can be conduction cooled. In other embodiments, more than three grids can be mounted together (more than one intermediate grid). In some embodiments, a device 26 such as an electrical power source can be electrically connected via an electrical line 26*a* to the support plate or grid 23 of the exit window 15 to apply an electric potential or voltage to one or more of grids 16, 18 and 20. This can cause electrical or magnetic deflection of the electrons $e^-$ of the internal electron beam 14 to reduce electron $e^-$ interception on the grid 23, thereby increasing the effective transparency of the exit window 15. In some embodiments where electrical power source 26 is used, a single grid such as in FIG. 1 can be employed or, two or more grids.

In the various embodiments, the upper or outer grid (such as 18 or 20) that is in contact with the exit window foil 12, can be made of material with a similar or the same coefficient or thermal expansion (CTE), or the same material, as the foil material of the exit window foil 12. Such materials can be metallic or nonmetallic and can include: beryllium, boron, carbon, magnesium, aluminum, silicon, titanium, copper, molybdenum, silver, tungsten, gold and combinations thereof, materials such as tungsten copper (fabricated by powder metallurgy) and silicon carbide, aluminum nitride, beryllium oxide (ceramics).

The masking first, inner, or lower grid 16 can be made of a lower Z material so as to minimize x-rays created from electrons $e^-$ intercepted by grid 16. Such materials can be metallic or nonmetallic and can include the upper grid materials listed above. In some embodiments, the grids can be made of the same materials, such as copper, as described in a previous example. The first grid 16 can also be plated or coated with low Z materials, such as beryllium, boron, carbon, aluminum, silicon, or compounds containing these. Although an example of a thickness of 0.3 cm has been previously described for the grids, this dimension can be varied for one or all grids. In some embodiments, the entire grid structure can be made of micromachined silicon (or other material) with a transmissive window layer deposited or bonded to it. The first 16 and second 18 or additional grids can be brazed or welded together at the outer perimeters or joined by other suitable methods.

The exit window foil 12 can be metallic or nonmetallic, and can be made of beryllium, boron, carbon or carbon based material such as a polymer, magnesium, aluminum, silicon, or titanium, combinations thereof, or oxides, nitrides, or carbides of these materials. The grid materials and exit window foil 12 materials can be selected so as to match coefficients of thermal expansion, or can have the same materials, so that the grid and exit window foil 12 can expand at similar rates providing for more thermally robust exit window foil which can prevent wrinkles in the exit window foil 12. For example, the exit window foil 12 and the outer grid surface 15*c* can both be titanium, or other suitable materials. Depending on the design, in some embodiments, the CTEs can be different. The exit window foil 12 can be a multilayer structure that includes various coatings for purposes such as corrosion protection or thermal conductivity. The coatings may include the previously listed foil materials, but also materials well known to be corrosion resistant such as gold and platinum. Embodiments of the exit window foil 12 can have thicknesses which can range from about 4-13 micrometers thick, but in some cases, can be thicker.

Bonding the exit window foil 12 to the upper or outer grid (such as 18 or 20), can be accomplished through diffusion bonding, brazing, soldering, cementing, welding (e.g. laser welding), or other hermetic attachment techniques. This can be done as a separate process at the time of electron beam emitter vacuum processing, or may be done independently. The benefits of bonding the exit window foil 12 to the upper grid independently can include allowing the initial vacuum integrity to be tested prior to processing the entire emitter 30, emitter 30 processing time can be shorter, and exit windows 15 can be manufactured in a batch process, and more efficiently.

The bonding of the exit window foil 12 to the grid (such as 18 or 20), can be done as a perimeter type of bond in order to make a vacuum seal. In addition, the exit window foil can be bonded continuously across the upper or outer grid surface 15*c* which can improve heat transfer between the exit window foil 12 and the grid, as well as thermal expansion effects. For a perimeter type of bond, the pressure due to atmosphere on one side and vacuum on the other pushes the exit window foil against the grid (such as 18 or 20), and provides some degree of contact for heat transfer. With a continuous surface bond, there is essentially no thermal impedance between the two materials and therefore can provide improved heat transfer. This can allow the exit window foil 12 to operate at a lower temperature for the same power level versus a foil bonded at the perimeter only. The bonding may be accomplished by means of diffusion, by welding, brazing, soldering or other bonding methods.

The grid structure and exit window 12 may be attached to the rest of the vacuum enclosure or connecting structures by various methods including welding, brazing, soldering, bolted wire seal or conflat joint, or other hermetic bonding methods. The grids of the exit window 15 can be diffusion bonded together, and can be done at the same time or different time that the exit window foil 12 is bonded to the upper grid (such as 18 or 20). The first grid or grids may alternatively be integral to the emitter 30 structure and the final grid supporting the exit window foil 12 may be attached to it, for example, by soldering. The apertures 16*a*, 18*a* or 20*a* may be in the form of holes or slots that are aligned to the beam trajectories, such as depicted in FIG. 3. The holes or slots can often have a diameter or width ranging from about 0.050 inches to 0.2 inches, or 0.1 cm to 0.5 cm. The upper grid 18 or 20 may also be contoured to provide a non-planar contoured surface for the outer grid surface 15*c* such as in FIG. 6A to accommodate a thermal expansion (CTE) mismatch with the exit window material. This contouring provides an increased surface area to mitigate CTE based stretching or gathering of a window material, such as by a high temperature bonding surface. A power density of about 10 $W/cm^2$ or higher and electron energies of 80 keV or higher are well suited to be used for an electron beam emitter 30 having an exit window 15. The first grid 16 which receives direct beam impact may also be part of a beam sensor system. In one implementation, one or more parts of the first grid 16, for example selected ribs of solid material regions 16*b*, may be electrically isolated and used as beam pickups to determine beam intensity and distribution, with provision made for external connection to one or more devices 26, which can be sensors, such as with one or more electrical lines 26*a*. The exit window system can have various shapes and configurations and may be incorporated into a round nozzle type assembly as part of an electron beam system for bottle sterilization, in which the exit window 15 can be round. Electron beam emitters 30 utilizing the masked grid method can achieve a performance and/or reliability advantage versus traditional technology, and this can apply to any broad beam application, such as sterilization, print curing, destruction of volatile organic compounds etc.

In some embodiments, the exit window foil 12 can be titanium, the intermediate, upper or outer grid (such as 18 or 20) copper or tungsten, and the first grid 16 copper. Although copper and titanium have different CTEs, they are often used together due to copper's high thermal conductivity and titanium's corrosion resistance. In hermetically sealed emitters, such as in some embodiments of emitter 30, the use of hermetically sealed joints gives rise to additional complexity, as the coefficients of thermal expansion, CTE, of adjacent materials in some embodiments may differ considerably. For example, the CTE of copper is on the order of 10 um/m/C greater than titanium. Hermetically sealed electron beam emitters typically require a bake out at elevated temperature to reduce outgassing of constituent materials such that, once sealed, a good working vacuum can be maintained. If the exit window structure is fabricated by permanently joining a metal exit window foil 12 membrane to a grid (such as 18) with a different CTE, the vacuum bake out can cause wrinkles to be formed. By way of example, consider titanium (Ti) foil bonded to a copper (Cu) grid. If the hermetically sealed joint is made while the materials are substantially at room temperature, elevating the temperature of the structure for bake out can cause the exit window foil 12 to be stretched beyond its elastic limit by the strain imposed by the grid by virtue of its larger CTE. When returned to room temperature, the excess foil which results from this plastic deformation can gather into wrinkles across the surface.

Wrinkling of the exit window foil 12 in an electron transparent membrane can present several problems. The electron beam typically intercepts the exit window normal to its travel direction. If a wrinkle is present, the beam strike is more oblique, and therefore intercepts an increased effective thickness of foil. This can lead to preferential energy absorption and heat load. Note also that a portion of the foil is separated from the heat sinking grid which can exacerbate the heat rise. On the atmospheric side, wrinkles can disrupt and degrade convective cooling as well. The local stiffening of the foil caused by the wrinkle can act as a stress riser and lead to low cycle fatigue failure.

In the present invention, CTE mismatch problems can be mitigated by diffusion bonding the exit window foil 12 to the grid surface 15*c* of the grid (such as 18 or 20) in a substantially continuous manner across the surface of the grid. In this way, the macroscopic wrinkles and the attendant problems described above can be eliminated.

Figure 7:
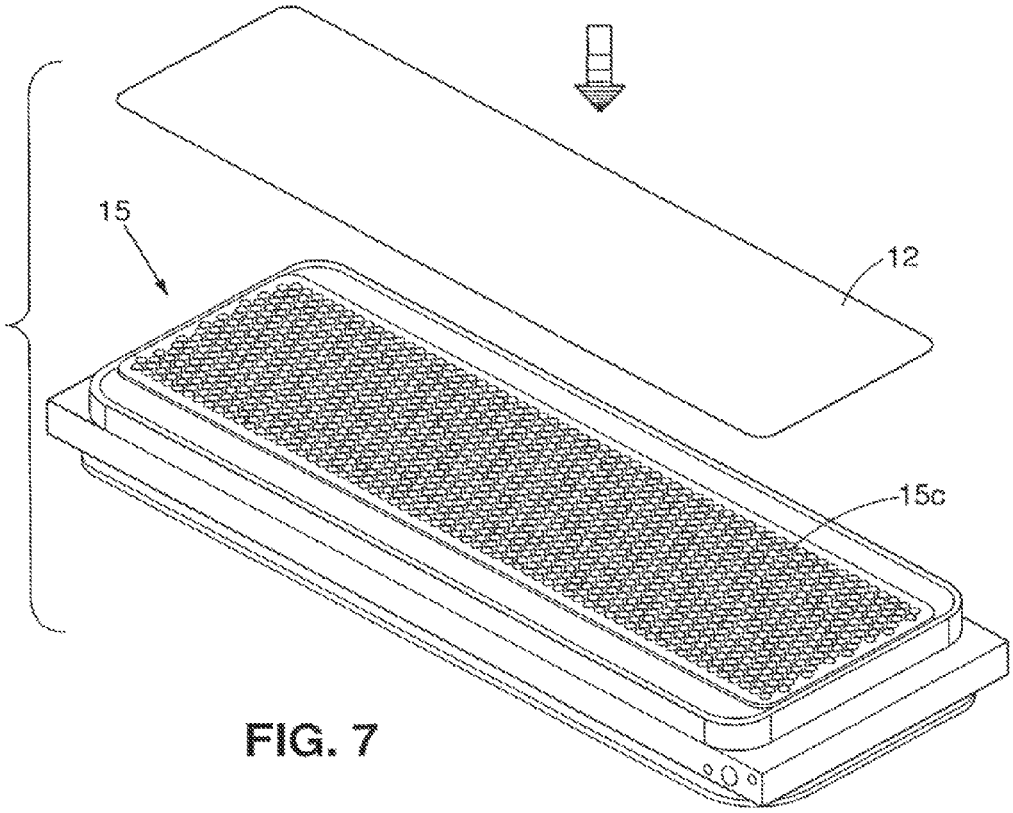
FIG. 7 is a perspective view of an embodiment of an exit window in the present invention in which the exit window foil is being bonded thereto.
Figure 8:
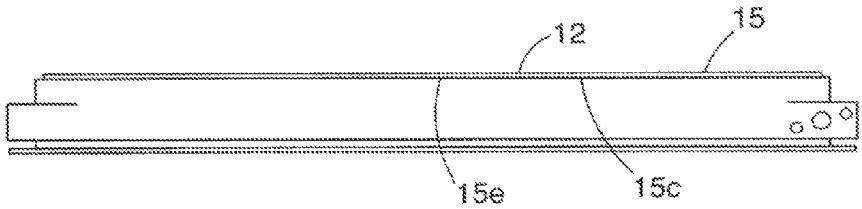
FIG. 8 is a side view of the embodiment of the exit window of FIG. 7 with the exit window foil having a continuous full face bond with the grid surface.

A titanium (Ti) exit window foil 12 can be diffusion bonded to the outer grid surface 15*c* of a grid (such as 18 or 20) by applying pressure at elevated temperature under vacuum (FIGS. 7 and 8). This can form a continuous full face bond 15*e* of the exit window foil 12 to the grid surface 15*c* of the grid (such as 18 or 20) over the grid portion (such as 18*c* or 20*c*). With the exit window foil 12 hermetically sealed to the grid, the window structure may be pre-tested to ensure that it is sufficiently leak tight. The ability to test and re-work, if necessary, at this assembly level provides a substantial benefit to emitter production yield since foil defectivity is a primary driver for yield loss, and this test precedes the emitter evacuation and conditioning process which is time consuming and is performed on high value equipment.

In a continuous or full face bond 15*e* of an exit window foil 12, the free span of foil between attachment points is reduced significantly in comparison to an exit window bonded only at its perimeter. Since the foil that is used is typically fabricated by cold rolling, pre-existing microscopic defects are common. In a perimeter bond of an exit window foil, by stretching the foil from its perimeter, the strain is borne by the "weakest" areas of foil (the areas with highest defect density, local thinning, or inclusions). In the present invention, by bonding continuously over the grid surface 15*c*, the free span of foil is limited to the much smaller area defined by the holes or slots (i.e., the windowlettes), such strain concentration is restricted or minimized.

In addition, with a continuous full face bond 15*e*, the thermal impedance at the foil/grid interface is reduced. In a conventional window, the foil is typically brought into contact with the grid by the ambient pressure outside the vacuum vessel. Since the physical contact between foil and grid occurs in vacuum, significant thermal impedance can be created by small voids. In the present invention, by diffusion bonding the exit window foil 12 directly to the grid, surface 15*c*, the two materials are brought into intimate contact, eliminating the small voids created by imperfect geometry.

While this invention has been particularly shown and described with references to example embodiments thereof, it will be understood by those skilled in the art that various changes in form and details may be made therein without departing from the scope of the invention encompassed by the appended claims.

The above examples have been described for electron beams, but can also apply to ion beams, x-rays, and optical beams that rely on vacuum windows. In addition, features of the various exit windows described can be omitted or combined, or have different configurations. In some embodiments, the apertures in the grids and insulating member can have shapes other than slots, for example, can be round. Furthermore, the exit window 15 can have other shapes, such as a generally round shape. It is also understood that the electron beam emitters and exit windows in the present invention can include other suitable shapes, configurations or dimension than those shown or described.

What is claimed is:

1. An exit window comprising:

an exit window foil;

a first support grid having a series of apertures, the first support grid contacting and supporting the exit window, and a surface of the first support grid bonded to the exit window foil in a substantially continuous manner across the surface of the first support grid; and a second support grid thermally isolated from the first support grid and having a second series of apertures in alignment with the series of apertures of the first support grid.

2. The exit window of claim 1 further comprising a hermetical seal between the exit window foil and the first support grid.

3. The exit window of claim 1, wherein the free spans of the exit window foil that are not bonded to the first support grid are limited to the spans corresponding to the apertures of the first support grid.

4. The exit window of claim 1, wherein the bond between the surface of the first support grid and the exit window foil is arranged to substantially prevent voids from forming between the exit window foil and the first support grid.

5. The exit window of claim 1, wherein the exit window forms an exit window of an electron beam emitter.

6. The exit window of claim 1, wherein:

the bond between the exit window foil and the surface of the first support grid forms an interface between the exit window foil and the first support grid; and the bond between the exit window foil and the surface of the first support grid is configured to reduce the thermal impedance at the interface.

7. The exit window of claim 1, wherein the bond between the exit window foil and the surface of the first support grid is configured to minimize the strain on the weakest areas of the exit window foil.

8. The exit window of claim 1, wherein the exit window foil has a thickness of 4 to 13 micrometers.

9. The exit window of claim 1, wherein the exit window foil is made of titanium.

10. A method for forming an exit window comprising:

placing a surface of a first support grid having a series of apertures in contact with an exit window foil such that the first support grid supports the exit window;

bonding the exit window foil to the surface of the first support grid in a substantially continuous manner across the surface of the first support grid, and arranging a second support grid having a second series of apertures such that the second support grid is in alignment with the series of apertures of the first support grid and the second support grid is thermally isolated from the first support grid.

11. The method of claim 10 further comprising:

testing the exit window to ensure a hermetic seal between the exit window foil and the first support grid.

12. The method of claim 10, wherein the free spans of the exit window foil that are not bonded to the first support grid are limited to the spans corresponding to the apertures of the first support grid.

13. The method of claim 10, wherein bonding the exit window foil to the surface of the first support grid substantially eliminates voids between the exit window foil and the first support grid.

14. The method of claim 10 further comprising:

attaching the exit window to an electron beam emitter to form an exit window for electron beams emitted from the electron beam emitter.

15. The method of claim 10, wherein:

the bond between the exit window foil and the surface of the first support grid forms an interface between the exit window foil and the first support grid; and bonding the exit window foil to the surface of the first support grid reduces the thermal impedance at the interface.

16. The method of claim 10, wherein bonding the exit window foil to the surface of the first support grid minimizes the strain on the weakest areas of the exit window foil.

17. The method of claim 10, wherein the exit window foil has a thickness of 4 to 13 micrometers.

18. The method of claim 10, wherein the exit window foil is made of titanium.

* * * * *